428-570 SR
3/6/84 XR 4,435,189

United States Patent [19]
Bovenkerk

[11] 4,435,189
[45] Mar. 6, 1984

[54] METHOD OF PREPARING ROUGH TEXTURED METAL COATED ABRASIVES AND PRODUCT RESULTING THEREFROM

[75] Inventor: Harold P. Bovenkerk, Worthington, Ohio

[73] Assignee: General Electric Company, Worthington, Ohio

[21] Appl. No.: 339,575

[22] Filed: Jan. 15, 1982

[51] Int. Cl.[3] ..... C23C 3/02
[52] U.S. Cl. ..... 51/295; 51/298; 51/309; 427/217; 427/304; 427/404; 428/403; 428/570; 148/31.5
[58] Field of Search ..... 51/295, 298, 309; 427/217, 304, 404; 428/403

[56] References Cited

U.S. PATENT DOCUMENTS 3,923,476 12/1975 Roy ..... 51/295
4,278,448 7/1981 Ishizuke ..... 51/295

FOREIGN PATENT DOCUMENTS 2124637 12/1971 Fed. Rep. of Germany ..... 427/217
51-49130 4/1976 Japan ..... 427/304

*Primary Examiner*—John D. Smith
*Attorney, Agent, or Firm*—Robert R. Schroeder; Douglas B. Little

[57] ABSTRACT

An improved metal coated abrasive is prepared with a controlled, rough textured surface, which surface has improved adherence to resinous materials when said coated abrasives are incorporated into resin bonded tools. Disclosed is a process for achieving this rough texture through a modification to the known electroless or autocatalytic techniques for coating abrasives with metals such as copper and nickel. The improvement comprises: interrupting the electroless coating process by passivating the surface one or more times; and then reactivating the passivated surface each time with a catalytic material whereby an array of preferential sites for metal deposition is obtained; and resuming normal electroless coating.

7 Claims, No Drawings

METHOD OF PREPARING ROUGH TEXTURED METAL COATED ABRASIVES AND PRODUCT RESULTING THEREFROM

TECHNICAL FIELD

This invention pertains to processes for electroless coating of abrasives such as diamond and cubic boron nitride with metals such as nickel. It represents an improvement in the electroless or autocatalytic methods which are well known by those skilled in the art of preparing diamind and cubic boron nitride (CBN) grinding grit.

BACKGROUND OF INVENTION

Metal coated abrasives such as diamond and cubic boron nitride have been used in resin bonded abrasive tools for many years, since the discovery that abrasive tools containing only these specific abrasives are uniquely beneficiated when the metal coatings are relatively thick and continuous, the usual thickness being about 1/10th to 1/50th of the base particle diameter. When used in grinding wheels the performance is enhanced from two to five fold as measured by longer wheel life, see e.g. U.S. Pat. Nos. 3,645,706 and 3,957,461.

This increased performance results from a combination of a number of factors such as: (a) more uniform dispersion of the abrasive in the matrix, (b) improved chemical bondability, (c) improved mechanical bonding, (d) a mechanical shell holding cracked grains together, (e) a high melting point, hard layer which absorbs thermal energy generated in grinding which would soften and degrade the resin and other factors.

The most common method of metal coating these electrically non-conducting abrasives is by the electroless plating process. In a typical process the surface of the abrasive is "activated", i.e. by deposition of spots of palladium on the surface through the decomposition of a palladium salt (e. g. Palladium Chloride). Prior to this activation step, the crystal surface may be sensitized by agitating the crystals in a heated bath of stannous chloride. U.S. Pat. No. 3,556,839 teaches a continuous process for coating diamonds with nickel by the electroless process. A batch process for accomplishing the same thing is explained in Example 3 of U.S. Pat. No. 3,904,391.

A good general discussion of electroless plating is found in Lowenheim, F. A., Electroplating, McGraw-Hill Book Co., 1978, Chapter 17. Through Lowenheim and through two previously mentioned U.S. Pat. Nos. (3,556,839 and 3,904,391 which are incorporated by reference herein) several different nickel plating bath compositions are taught along with the appropriate conditions. The bath temperatures seem to range between 57° and 95° C., and pH ranges from 4 to 11. If a batch type process is used, treatment of the crystals in one plating bath batch may be insufficient, after depletion of the metal content, to obtain the desired coating thickness. Therefore, a series of sequential batch steps called stations (as many as 10 to 30) may be necessary. In normal practice, each coating or plating bath station is depleted to about 80 to 85 percent of its metal content (taking about 20 minutes) at which time the bath is emptied of liquid and a fresh coating bath started. However, the activation step (e. g. addition of palladium chloride) need only be performed in the initial bath. Hydrogen gas is evolved during the process, and therefore, adequate exhaust ventilation is required. Sufficient agitation is required during the coating to prevent crystal agglomeration.

It has been found that metal coatings of increased exterior surface roughness lead to improved abrasive tool performance, probably because of the increased area for mechanical and/or chemical bonding. Inherent in the electroless metal coating process is that, as it is normally practiced, the surface tends to get smoother as the metal layer is built up (see U.K. Pat. No. 980,030, p. 4, lines 23–26), hence the desired roughness of the final surface is not achieved.

One method to roughen the surface of metal coated diamond is given in U.S. Pat. No. 3,650,714. This patent proposes adding ceramic whiskers during the coating of diamond with copper or nickel and also obtaining roughness by heating a mixture of sponge iron and braze coated diamond under a vacuum.

Irish patent No. 21,637 teaches a process for electroless nickel coating of a nonmetallic body wherein the surface of said body is physically roughened in order to help secure the activating palladium salt.

The object of this invention is to create a rough surface metal coated crystal without having to resort to the techniques of the last two mentioned patents.

SUMMARY OF THE INVENTION

In its broadest aspect, this invention comprises an improved process for the electroless coating of noncatalytic materials with a coating metal selected from the group consisting of nickel, cobalt, palladium, copper, gold, silver and alloys thereof which comprises:

(a) treating the non-catalytic material with a catalytic material; and (b) contacting the non-catalytic material with an aqueous solution containing coating metal ions and ions of a reducing agent capable of reducing the metal ions to the free metal;

wherein the improvement comprises:

(i) interrupting the coating process by passivating the surface being coated;

(ii) reactivating the passivated surface wth catalytic material whereby an array of preferential sites for metal deposition is obtained; and (iii) resuming the coating process of step (b) whereby a rough surface is obtained.

A catalytic material means any material which can be plated or coated with one of the listed coating metals in an aqueous bath containing the coating metal cation plus the reducing agent anion. For purposes of this description, a catalytic material is catalytic for the oxidation of the reducing anion, and it is capable of being coated with the coating metal by virtue of the initial displacement deposition of coating metal thereon. In the case of nickel coating, the following elements are examples of catalytic materials: iron, cobalt, nickel, palladium, platinum, beryllium, magnesium, aluminum, silicon, titanium, vanadium, chromium, manganese, zinc, germanium, selenium, molybdenum, cadmium, tellurium, tungsten, copper, silver, tin, gold, lead, and bismuth. The preferred catalytic material is palladium chloride.

In the above description, treating the non-catalytic material with the catalytic material would typically be done by stirring the diamond or CBN in a solution of palladium chloride in hydrochloric acid.

A typical coating bath solution for nickel coating would comprise nickel ions and hypophosphite ions as the reducing agent. One source for nickel ions is nickel sulfate, and a source of hypophosphite ions is sodium hypophosphite. A second source for nickel ions could be nickel chloride. It is also normal for electroless plating bath solutions to contain buffers, complexing agents (to complex with the nickel) and exaltants to increase deposition rate. Sodium acetate and sodium hydroxyacetate may serve one or more of these functions.

Step (b) is typically accomplished by agitating the diamond or CBN crystals in the aqueous coating solution. The thin immersion deposit of palladium on the surface of the diamond or CBN is sufficient to initiate the reduction of the nickel ions by the hypophosphite ions near the crystal surfaces, and the process proceeds to form a nickel shell around the crystals.

In order to create a rough surfaced metal coating, the surface is passivated in step (i) such as by oxidation, coating with a thin layer of nonmetallic material such as resin or the like. The surface now has to be reactivated so the coating process will continue. This reactivation gives preferential sites for metal deposition leading to a fine array of nodules in the final stages of forming the metal surface. Hence, a rough surface is produced. This interruption by passivating the surface may take place one or more times during the coating process.

It is proposed that the interruption takes place after 5 or 10 stations. If the interruption is by oxidation, it may be achieved by heating the crystals being coated in an acid (e.g. $HNO_3$) or by treating them with any oxidizing agent. If nitric acid is used it must be for a very short time, since it is reactive with the nickel coating. Therefore a dilute acid should be used. A useful oxidizing method would be heating in air or oxygen to form nickel oxide, using a temperature in the range of 300° to 800° C. (the upper limit being the melting point of the coating) for a time sufficient to form an oxide. Other oxidizing agents such as fused nitrites could be used. For example, the nickel coated diamond could be heated in fused nitrite until oxide is formed.

Alternatively, the coating could be passivated by applying a thin layer to the crystals which could be of a number of materials such as: solutions of epoxide, silicones, temperature (heat) or ultraviolet light cured polymers, phenol formaldehyde resins, paints, varnishes, low melting glasses, or the like. For example, nickel coated diamond could be coated with phosphate glass by reacting it with glass powder in a furnace. Reactivation would be by the same process as step (a).

Control of the density of nucleation sites is achieved by adjusting the duration of the reactivation step (exposure of diamond to the palladium chloride). The temperature of that step is another means for controlling palladium deposition rate and thus nucleation site density.

The ratio of nickel ions to hypophosphite ions is important since it may affect the specific gravity and phosphorous content of the ultimate coating. Electroless nickel deposits from hypophosphite baths are not pure nickel, but they contain a certain percent (typically 3–15) phosphorous. The coating bath temperature also affects the phosphorus content of the ultimate coating. As temperature increases, phosphorous content decreases and vise versa. Suitable operating ratios and temperatures may be found in the patents and literature previously mentioned in the background section.

The point at which the desired weight ratio of nickel to diamond or CBN has been achieved is determined by conventional assay technique, at which point the coating process is terminated. Normally, the crystals are then rinsed with cold deionized water a sufficient number of times until the last water rinse has a neutral pH. Afterward, the crystals are dried, sieved to size, and inspected for coating color and texture.

A resin bond grinding wheel containing improved, rougher grit described above can be formed in the conventional manner as taught, for example, by U.S. Pat. No. 3,645,706. Typically the grit and resin (e.g. phenolic, epoxy or polymide resin) powders are mixed. A wetting agent (furfural) and secondary abrasive (e.g. silicon carbide) may be added. Concentrations of the primary abrasive (e.g. diamond or CBN) are typically 1 to 9 carats/$cm^3$. The mixture is loaded into a mold cavity containing a wheel core and hot pressed, typical conditions being about 180° C. and about 68 MegaPascals for 30 minutes. Pressure is not necessarily constant since the mold is typically closed to a predetermined stop. The wheel is cured after removal from the mold at an elevated temperature (e.g. 190° C.).

BEST MODE FOR CARRYING OUT THE INVENTION

The invention will be further clarified by the following examples which are intended to be purely exemplary. Both are prophetic examples which are based upon the electroless coating of diamond with nickel in accordance with the description in the background section and under the heading Summary of the Invention. Step (a) would be performed by stirring diamond particles in a palladium chloride solution. Step (b) would be accomplished by agitating the diamonds in an aqueous solution containing nickel sulfate and sodium hypophosphite in deionized water. The starting material for both examples would be diamond which has been nickel coated to a level of about fifty percent of the final coating thickness.

EXAMPLE I

If the starting material were heated in air to a temperature of about 600° C. for about one hour, a passivating coating would be formed. The oxidized nickel coating would then be reactivated with a palladium chloride solution or other nucleating agent, and the nickel coating would be built up on the new nucleation sites in accordance with the process of step (b) to the final thickness. A coating rougher in texture than the normal nickel coated grit would be observed.

EXAMPLE II

The starting material could be mixed with powdered borosilicate glass and a fugacious binder of PVA (polyvinylalcohol) to coat the diamond with a layer of powdered glass and binder. The diamond would then be dropped through a vertical tube furnace at a temperature of 1000° C. The glass would melt and coat the nickel coated diamond. The glass coating surface could be activated by the previously described palladium salt technique, and the nickel coating built up to the final thickness. A rough textured coating would be obtained.

Other embodiments of this invention will be apparent to those skilled in the art from a consideration of this specification or practice of the invention disclosed herein. Various omissions, modifications and changes to the principles described herein may be made by one skilled in the art without departing from the true scope and spirit of the invention which is indicated by the following claims.

What is claimed is:

1. An improved nickel coated crystal of diamond or cubic boron nitride which is made by the steps of:

(a) treating said crystals with an acidic solution of palladium chloride; and (b) stirring said treated crystals in an aqueous solution containing coating nickel ions and hypophosphite ions capable of reducing said nickel ions to the free metal for coating said crystals;

the improvement which comprises the additional steps of:

(i) interrupting step (b) by forming a passivated coating on the nickel-coated crystals of step (b);

(ii) reactivating said passivated coated crystals with additional acidic solution of palladium chloride whereby an array of preferential sites for nickel coating deposition is obtained; and (iii) resuming the coating process of step (b) whereby a rough nickel surface is obtained.

2. The improved nickel coated crystal of claim 1 wherein the aqueous solution in step (b) contains nickel sulfate and sodium hypophosphite and said passivated coating in step (i) is formed by oxidation of the nickel coating.

3. The improved nickel coated crystal of claim 2 wherein said oxidation is achieved by heating said crystals in step (i) in an oxidizing acid.

4. The improved nickel coated crystal of claim 1 wherein said oxidation is achieved by treating said crystals in step (i) with an oxidizing agent selected from the group consisting of oxygen and fused nitrites.

5. The improved nickel coated crystal of claim 1 wherein said passivated coating in step (i) is a thin organic coating selected from the group consisting of phenolic resins, epoxides, heat-cured polymers, and ultra-violet radiation cured polymers.

6. The improved nickel coated crystal of claim 1 wherein said passivated coating in step (i) is a thin coating of glass.

7. A resin bond grinding wheel containing the improved nickel coated crystals of claim 1.

* * * * *